United States Patent [19]

Hue

[11] Patent Number: 4,676,522

[45] Date of Patent: Jun. 30, 1987

[54] SAFETY BINDING FOR A SKI BOOT

[75] Inventor: Jean Hue, Annecy, France

[73] Assignee: Salomon S.A., Annecy, France

[21] Appl. No.: 513,101

[22] Filed: Jul. 12, 1983

[30] Foreign Application Priority Data

Jul. 13, 1982 [EP] European Pat. Off. ..... 82420099.2

[51] Int. Cl.[4] ..... A63C 9/02

[52] U.S. Cl. ..... 280/615

[58] Field of Search ..... 280/615, 620, 628, 618, 280/635

[56] References Cited

U.S. PATENT DOCUMENTS

| | | | |
|---|---|---|---|
| 2,144,021 | 1/1939 | Keiner | 280/618 |
| 2,383,064 | 8/1945 | Lanz | 280/618 |
| 2,534,038 | 12/1950 | Lanz | 280/618 |
| 2,545,574 | 3/1951 | French | 280/618 |
| 2,676,813 | 4/1954 | Beyl | 280/618 |
| 3,845,964 | 11/1974 | Johnson | 280/618 |
| 3,866,928 | 2/1975 | Gertsch et al. | 280/618 |
| 4,185,852 | 1/1980 | Himmetsberger et al. | 280/618 |
| 4,382,611 | 5/1983 | Salomon | 280/618 |

FOREIGN PATENT DOCUMENTS

| | | | |
|---|---|---|---|
| 7723934 | 11/1977 | Fed. Rep. of Germany | 280/618 |
| 2907365 | 2/1979 | Fed. Rep. of Germany | 280/618 |
| 806551 | 12/1936 | France | 280/618 |
| 890005 | 1/1944 | France | 280/618 |
| 1011091 | 6/1952 | France | 280/618 |
| 1166145 | 11/1958 | France | 280/618 |
| 2447731 | 8/1980 | France | 280/615 |
| 2497595 | 1/1981 | France | 280/618 |
| 8206434 | 4/1982 | France | 280/618 |
| 88427 | 2/1937 | Sweden | 280/618 |

*Primary Examiner*—John J. Love
*Assistant Examiner*—Eric D. Culbreth
*Attorney, Agent, or Firm*—Sandler & Greenblum

[57] ABSTRACT

An apparatus for connecting a ski boot to a ski having a binding that is adapted to permit the heel of the boot to be lifted from the ski in normal use. In addition, the binding is also adapted to permit the boot to pivot around the vertical pivot axis. The vertical pivot axis passes through a support zone of the foot which is bounded by the phalanges and metatarsals of the foot. In one preferred embodiment the vertical pivot axis passes through the journal axis around which the metatarsals journal on the phalanges. As a result, lateral forces that are produced as a result of normal skiing by the foot acting against boot cause only a negligible torsion moment because these forces act at the vertical pivot axis, and therefore the lever arm is negligible. In another embodiment, the apparatus is adapted to attach a small boot or a large boot to the ski. In this embodiment, the vertical pivot axis is located so as to pass through the area common to the support zone of the foot in the large boot and the support zone of the foot in the small boot.

32 Claims, 8 Drawing Figures

SAFETY BINDING FOR A SKI BOOT

BACKGROUND OF THE INVENTION

1. Field of the Invention

The present invention relates to an apparatus for attaching a boot to a ski and more specifically relates to a safety binding for cross-country skiing.

2. Description of the Prior Art

Numerous apparatus are known which hold the front end of the boot on the ski, while allowing the heel to be lifted during skiing . The only movement possible in these apparatus is the lifting of the heel of the boot to permit skiing.

During skiing, to ensure the effective guiding of the ski by the skier, the front of the boot must be held with sufficient rigidity. As the rigidity with which the boot is held in the lateral direction across the foot increases, the ability of the skier to guide the ski becomes more precise. However, there are disadvantages to rigidly holding the boot to prevent lateral pivoting. In addition, such a binding creates great risks for the skier who does not possess a great technical facility in skiing and who does not ski with maximal ease and safety. These novice skiers ski in such a manner that their feet must make torsion movements relative to the ski, in order to avoid fractures. However, if their feet are held with a high degree of lateral rigidity, they cannot make these torsional movements necessary to avoid injury.

To overcome this problem safety-release bindings have been proposed that either allow a simple release of the boot from the ski or allow torsional movement of the boot relative to the ski without the release of the boot. German patent No. 2907365, German Utility Model No. 7723934, and French patent No. 8100358 are examples of these safety-release bindings.

According to various embodiments of these bindings, the binding is mounted on the ski so as to be adapted to rotate around a real vertical journal axis or around a virtual axis, formed by the cooperation of a section of a projection and a section of a groove. The pivoting axis is either placed under the front end of the boot as seen in FIG. 1 or in front of the boot, as seen in FIG. 2. Although this is an improvement over bindings that do not pivot, the location of the pivoting axis is not correct, and has serious shortcomings for the following reason. During skiing, either during the propulsion phase, during the duck walking phase, or even during descent, the action of the boot creates a force at the bottom of the foot, a distance from the pivot axis (denoted by F in FIGS. 1 and 2). This force F causes torsional movement of the boot which results in the lateral rotation and the release of the binding when the leg is not exposed to dangerous torsional forces. Thus, untimely releases of the boot will occur. The skier, to prevent these untimely releases and to improve the quality of his skiing is forced to increase the release threshold of the locking system that maintains the boot against lateral pivoting. However, this increased threshold does not allow the release of the boot when dangerous torsionazl movement occurs so that the binding is rendered completely ineffective when it is necessary to prevent injury to the leg.

SUMMARY OF THE INVENTION

The object of the present invention is to remedy the shortcomings described above by placing the pivoting axis beneath the bottom of the foot. Thus, during skiing, the resulting lateral force exerted by the boot on the binding will occur at the pivoting axis and, therefore the torsional moment will be zero or very low. Consequently, no untimely release of the boot will occur. By this arrangement, only when a fall occurs or when there are excessive torsional forces present does release of the boot occur, thus effectively ensuring the safety of the skier.

In one embodiment, the invention is an apparatus for connecting a ski boot having a heel to a ski. The boot is adapted to receive a foot having a support zone associated therewith. The apparatus comprises a binding which is adapted to permit the heel of the boot to be lifted from the ski in normal use and is adapted to permit the boot to pivot around a vertical pivot axis. The binding may be a cross country ski binding. The vertical pivot axis passes through the support zone of the foot when the foot is received in the boot held by the apparatus.

The support zone is defined as the area bounded by the front edge of the phalanges and rear edge of the metatarsals of the foot.

The binding is also be adapted to permit the boot to pivot in a plane parallel to the top surface of the ski.

The binding may include a locking means for releasably holding the boot in a centered position on the ski. This centered position is a position in which the longitudinal axis of the boot is substantially parallel to the longitudinal axis of the ski. The locking means releases the boot from its centered position so as to permit the boot to pivot around the vertical pivot axis when a predetermined torsion moment is experienced by the locking means. In addition, the locking means is adapted to vary the predetermined torsion moment which releases the boot. The binding may further include an axis pin for pivotally attaching at least a portion of the binding to the ski, and through which the vertical pivot axis passes. In this embodiment, the axis pin is located under the boot. In an alternative embodiment, the binding includes a holding means for holding the front of the boot and an axis pin pivotally attaches a pivot plate to the ski so that the plate is adapted to rotate around the vertical pivot axis which passes through the pivot pin. The pivot pin and/or the vertical pivot axis may be positioned approximately under the area between the third metatarsal and the third distal phalange of the foot, when the foot is received in the boot held by the binding.

In an alternative embodiment, the pivot pin and/or the vertical pivot axis is positioned beneath the area in common with both a large and small support zone. In this embodiment, the binding is adapted to attach a small or a large-sized boot to the ski. The small-sized boot is adapted to receive a small-sized foot having a small support zone associated therewith, and the large-sized boot is adapted to receive a large-sized foot having a large support associated therewith. In addition, or alternatively, the pivot pin and/or the vertical pivot axis may be positioned between first and second journal axes. The first journal axis is associated with the small-sized foot and comprises the axis around which a metatarsal of the small foot is journalled on a phalange of the small foot, when the small foot is received in the boot. The second journal axis is associated with the large-sized foot and comprises the axis around which a metatarsal of the large foot is journalled on a phalange of the large foot when the large foot is received in said boot.

In addition, the vertical pivot axis may be located halfway between the first and second journal axes.

In still another embodiment, the vertical pivot axis passes through approximately through the intersection of the longitudinal axis of the ski and a journal axis around which a metatarsal of the foot is adapted to rotate with respect to a phalange of the foot, when the foot is received in the boot. In still another embodiment the binding is adapted to adjust the position of the vertical pivot axis along the longitudinal axis of the ski.

In another embodiment, the invention relates to an apparatus for connecting a ski boot to a ski wherein the boot is adapted to receive a foot having a support zone associated therewith. In normal use of the boot and ski by a skier, a lateral force may be generated by the skier's foot against said boot in the support zone. The apparatus comprises a holding means and a pivoting means. The holding means holds the front of the boot and permits the heel of the boot to be raised from the ski. The pivoting means permits the boot to pivot laterally around a pivot axis. The pivot axis is sufficiently close to a line passing through the point at which the force is applied to the boot in the direction of the force, that the torsional moment created by the force is small. Furthermore, the pivot axis is located closer to this line than the front edge of the longest toe of the foot when the foot is received in the boot held by the apparatus. Alternatively, the position of the pivot axis is such that the torsional moment created by the force is substantially zero.

In another embodiment, the apparatus further includes a locking means for releasably holding the boot against lateral pivoting. The locking means has a predetermined threshold such that when the torsional moment applied to the boot is above that threshold, the boot is free to pivot laterally. The pivot axis in this embodiment is sufficiently close to a line passing through the point at which the force is applied to the boot in the direction of the force, that the torsional moment created by this force is less than a threshold above which injury to the skier would occur in a fall.

The pivot axis may be positioned so that it passes through a support zone associated with the foot. In addition, the pivot axis may be positioned so that it passes approximately through a journal axis comprising the axis around which a metatarsal of the foot is journalled on a phalange of the foot, when the foot is received in the boot held by the apparatus.

The pivoting means may comprise a plate and an axis pin pivotally attaching the plate to the ski. The axis pin defines the pivot axis which passes therethrough. The pivot pin and the pivot axis in this embodiment may be located approximately under the area between the third metatarsal and third phalange of the foot when the foot is received in the boot.

In another embodiment, the invention relates to an apparatus for attaching a boot to a ski wherein the boot is adapted to receive a foot therein. The apparatus comprises a binding that is adapted to hold the front of the boot and allow the heal of the boot to be raised. In addition, the binding is adapted to permit the boot to pivot around a vertical pivot axis. The pivot axis is located closer to a journal axis on which a metatarsal of the foot is journalled on a phalange of the foot, than the front edge the longest toe of the foot, when the foot is received in the boot held by the binding.

BRIEF DESCRIPTION OF THE DRAWINGS

The invention will be better understood in view of the description which follows and in view of the drawings which are described below, wherein identical reference numerals denote elements having similar or identical functions in different embodiments, and wherein.

DETAILED DESCRIPTION OF THE PREFERRED EMBODIMENTS

Figure 1:
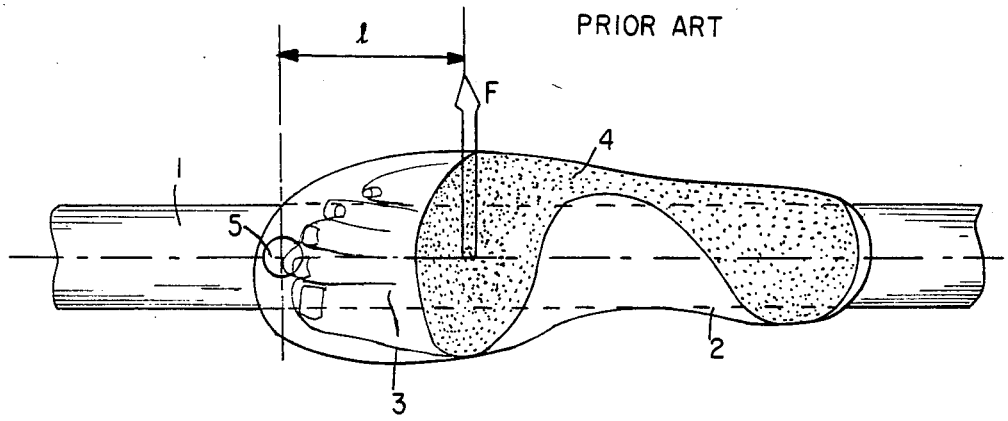
FIG. 1. PRIOR ART
FIGS. 1 and 2 illustrate schematic top views of the shortcomings of prior art bindings.
Figure 2:
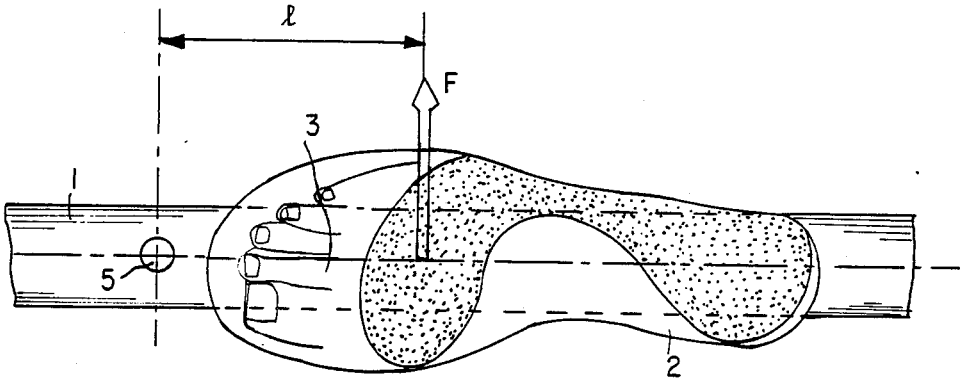
FIG. 2. PRIOR ART
Figure 3:
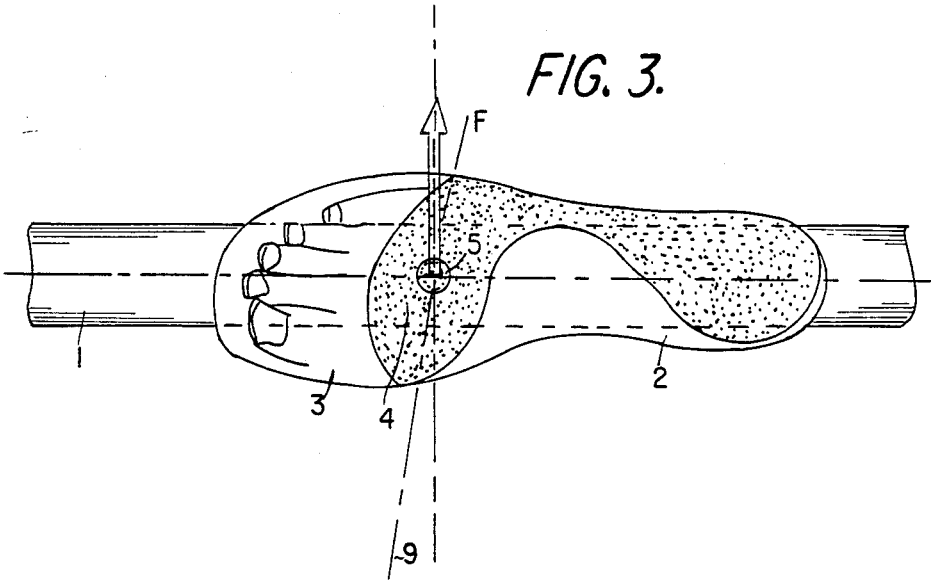
FIG. 3, illustrates a top view of a foot on the ski and the force F located at the pivoting axis to illustrate the principle of the present invention.

FIGS. 1–3 illustrate top views of a ski 1 on which a boot 2 rests. The exterior contour of boot 2 is shown in these figures. Inside boot 2 is outlined a foot 3 and a support zone 4 of foot 3. This support zone is illustrated by its exterior contour, shown in gray, when boot 2 is placed flat on ski 1, and the heel of the foot is not lifted. Support zone 4 is that portion of the foot in which significant forces are exerted between foot 3 of the skier and boot 2 in normal use. For example when the skier uses a duck walk movement or in similar situations, the skier's foot 3 is pressed against boot 2 in such a way that a lateral force F is produced in support zone 4 at the bottom of the foot as shown in FIGS. 1–3. As was discussed above, force F is quite normal and presents no danger for the skier, and any release of the safety binding (not shown in FIGS. 1–3) which attaches boot 2 to ski 1, due to this force F is undesirable and should be avoided.

FIG. 1 illustrates the working of a prior art binding disclosed in German application No. DE-A-2907365 and German Utility Model DE GM No. 723934 which are both hereby incorporated by reference. The binding (not shown) is disposed between boot 2 and ski 1 and is journalled on ski 1 around a vertical pivoting axis 5 located immediately in front of the foot 3, and is under the front of boot 2. A distance l separates pivoting axis 5 from the point at which lateral force F is applied to boot 2. Thus, a torsion moment F1 is exerted on the binding, which is $F \times l$. This binding is normally held in a centered position, in which the longitudinal axis of boot 2 is substantially parallel to the longitudinal axis of ski 1, by a locking system, which releases boot 2 so that boot 2 is free to pivot laterally around axis 5, when the torsion moment exerted on it surpasses a predetermined threshold. In the arrangement shown, during a somewhat rapid duck walk movement or under other conditions which are quite normal for skiing, the torsion moment F1 can easily exceed the threshold and easily cause an untimely release (shown by dashed lines), which often leads the skier to "strengthen", that is to increase the release threshold of his binding to avoid having to intervene too often. As discussed above, by increasing the release threshold the skier renders his binding ineffective when a release is necessary for the safety of the skier.

FIG. 2 illustrates working of another binding. This binding is disclosed in French patent application FR No. 8100358 which is hereby incorporated by reference and is even more unsatisfactory than the binding shown in FIG. 1. This binding is similar to the binding disclosed in FIG. 4 except that pivot axis 5 is well in front of the front of boot 2. The torsion moment of F1 is therefore greater than that of the preceding binding because l, the distance from the pivot axis to the point at which lateral force F is applied to the boot, is increased, and thus the shortcomings discussed above are amplified.

FIG. 3 illustrates the principle of the present invention. Vertical pivoting axis 5 is located in support zone 4 of foot 3 and more specifically, at or in the immediate vicinity of the point at which lateral force F is applied to boot 2. As a result the lever arm is small or substantially zero and therefore the torsional moment F1 is small or substantially zero. When vertical pivot axis 5 is so located, lateral force F produced by the duck walk of the skier will not cause the release of the safety binding, regardless of the type of hooking means used, the type of locking means used, or the type of torsion release mechanism used by the boot.

Figure 4:
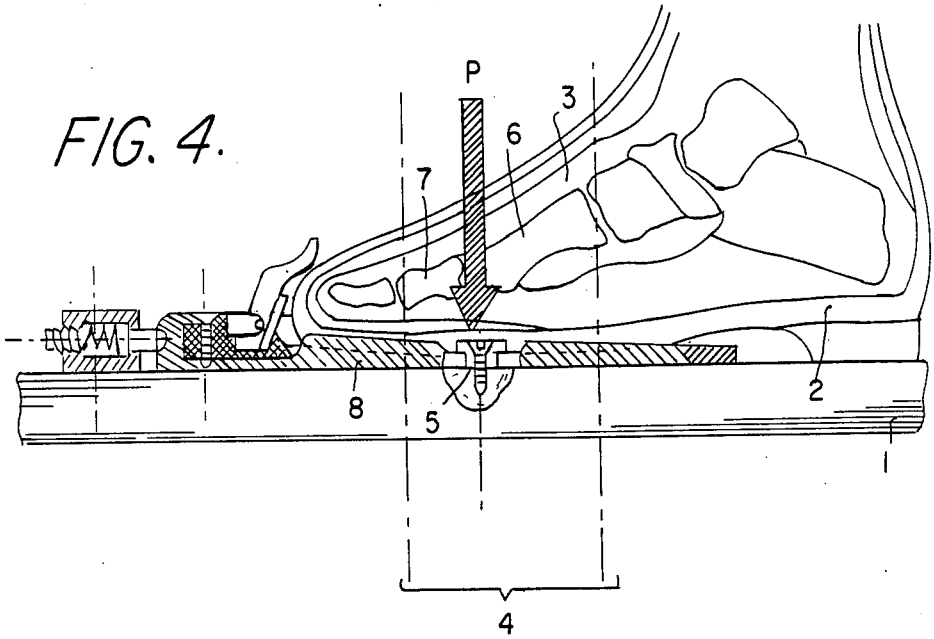
FIGS. 4 and 5 illustrate a longitudinal cross-sectional view and a top view, respectively, of one embodiment of the invention.
Figure 5:
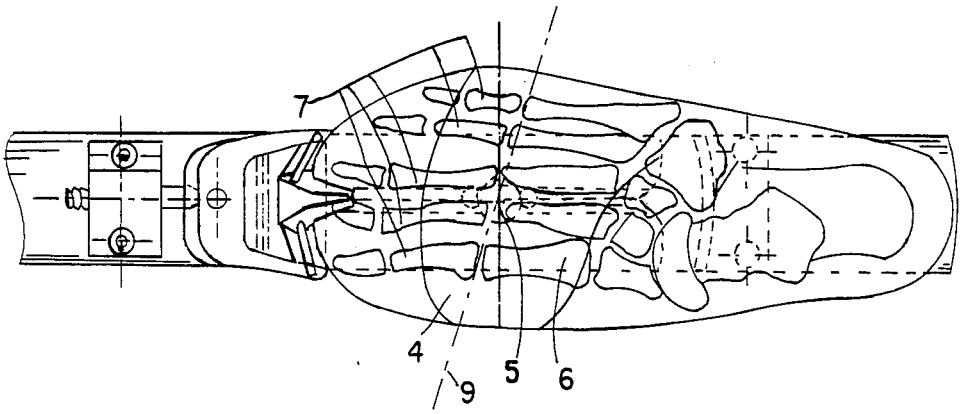
Figure 6:
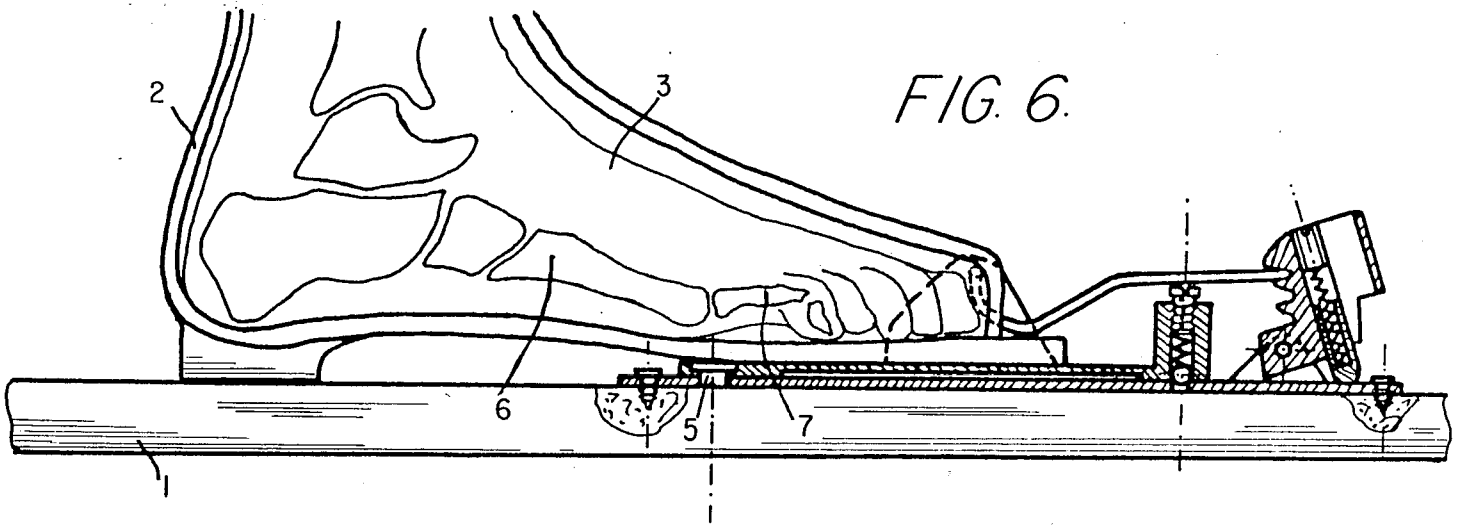
FIGS. 6 and 7 illustrate a longitudinal cross-sectional view and a top view, respectively, of another embodiment of the present invention.
Figure 7:
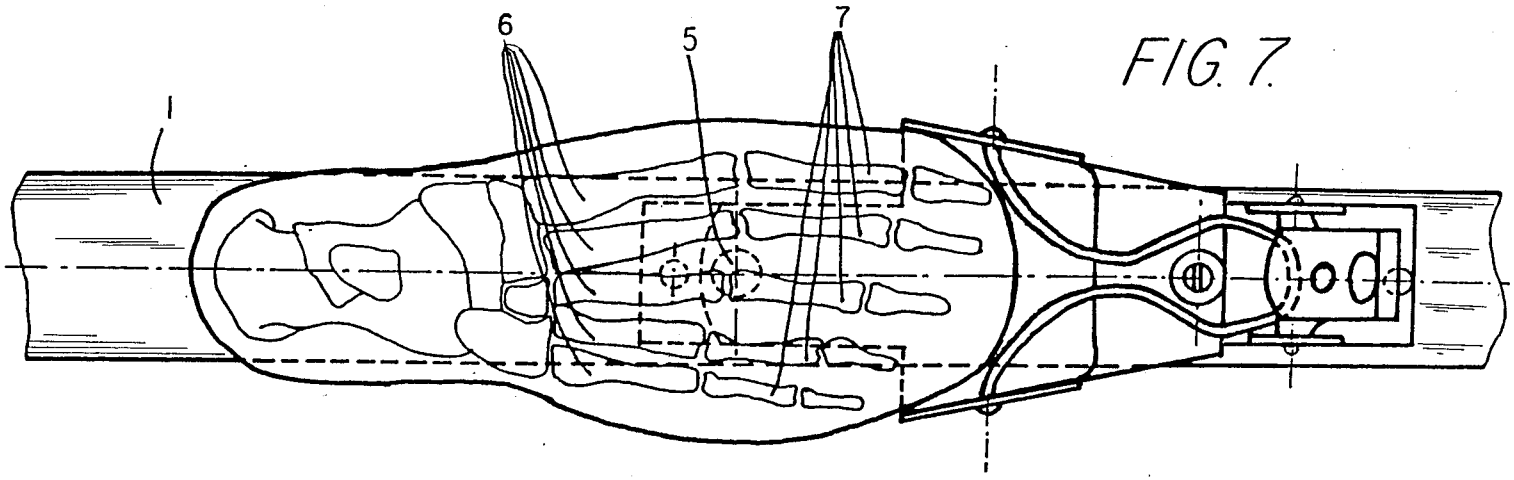

FIGS. 4 and 5 illustrate an embodiment of the invention corresponding to that illustrated in FIGS. 8–11 of French Patent application No. 8206434, filed Apr. 8, 1982 which is hereby incorporated by reference. The binding which attaches boot 2 to ski 1 is of the type described in U.S. Pat. No. 4,382,611 which claims priority based on French application No. 2447731 both of which are hereby incorporated by reference and it is thus not necessary to discuss this binding in detail here. FIGS. 6 and 7 illustrate, in an analogous manner to FIGS. 4 and 5, a second embodiment of the invention relating to a safety binding of the type disclosed in German Utility Model No. DE-GM-7723934 which is hereby incorporated by reference, so that a detailed description will also not be necessary.

Both embodiments relate to an apparatus for connecting a ski boot to a ski. The apparatus comprises a cross-country ski binding. The boot 2 is adapted to receive foot 3 having support zone 4 associated therewith. In normal use by the skier, a lateral force may be generated by a skier's foot 3 against boot 2 in support zone 4. Both bindings illustrated in FIGS. 4 and 5, and FIGS. 6 and 7 are adapted to hold the front of the boot and to permit the heel of boot 2 to be raised from the ski in normal use. Holding element 10 holds the front of the boot and permits the heel of the boot to be raised from the ski. In addition, the bindings in both embodiments are also adapted to permit the boot to pivot laterally around a vertical pivot axis indicated at 5 and to pivot in a plane parallel to the top surface of said ski. The vertical pivot axis passes through the support zone of the foot as will be discussed in more detail below, when foot 3 is received in boot 2 which is held by the binding. In addition, the pivot axis is sufficiently close to a line passing through the point at which the lateral force is applied to the boot in the direction thereof, that the torsion moment created by this lateral force is either small or substantially zero.

In FIGS. 4 and 5, the binding has a holding means 10 for holding the front of the boot, and a plate 8 which is pivotally connected to ski 1 by pivot pin 5. Plate 8 is adapted to pivot laterally around a vertical pivot axis passing through and defined by pivot pin 5.

FIG. 4 shows the bones in foot 3 of the skier. 6 is a metatarsal bone and 7 is a phalange. Metatarsal 6 is journalled on phalange 7 so as to create a journal axis 9 therebetween. Support zone 4 of foot 3 is that area of the foot bounded by the front end of phalanges 7 and the rear edge of metatarsal 6, as seen in dashed lines in FIG. 4. It is in this zone that significant forces are created which foot 3 against boot 2.

FIG. 5 shows a top view in which all five metatarsals 6 and their associated phalanges 7 can be seen. As is the custom in the terminology associated with human anatomy, the metatarsals and phalanges are numbered 1–5, with the metatarsal and phalange associated with the big toe being called the first metatarsal and the first phalange, and the bones associated the little toe being called the fifth metatarsal and phalange.

The force exerted at foot 3 in support zone 4 occurs along journal axis 9 between metatarsals 6 and phalanges 7. Thus, for example, vertical force P is seen in FIG. 4 acts on journal axis 9 between metatarsals 6 and phalanges 7. In addition, when the skier makes certain movements, such as a duck walk movement, lateral forces are generated in support zone 4 which act on boot 2. These lateral forces are applied to boot 2 at a point along a journal axis 9 on which a metatarsal 6 pivots on a phalange 7.

In order to minimize and prevent these lateral forces in support zone 4 from causing boot 2 to laterally pivot around the vertical pivot axis, the vertical pivot axis and pivot pin 5 are located at a carefully chosen point under boot 2. Pivot pin 5 and/or the vertical pivot axis are preferably located so that the vertical pivot axis passes approximately through the intersection of the longitudinal axis of the ski and the journal axis 9. Alternatively, pivot pin 5 and/or the vertical pivot axis can be located anywhere in the support zone or could also be positioned approximately under the area between the third metatarsal and the third phalange of the foot as seen in FIG. 5. In another embodiment, the vertical pivot axis is located closer to a journal axis around which a metatarsal of the foot journal on a phalange of the foot, than the front edge of the longest toe of the foot, when foot 3 is received in boot 2 held by the apparatus. In still another embodiment, pivot axis 5 is sufficiently close to a line passing through the point at which the lateral force is applied to boot 2 in the direction of the force, that the torsional moment created by the lateral force is small.

The embodiment shown in FIG. 5 also includes slot 11, larger than axis pin 5 in the longitudinal direction of ski 1 so that axis pin 5 can be adjusted to some extent along the longitudinal axis of ski 1. Pin 5 may be locked at any point along the length of slot 11.

A more detailed view of the binding illustrated in FIGS. 4 and 5 is illustrated in FIGS. 9 and 10.

In FIGS. 9 and 10, the means for attaching and laterally retaining the boot is made from a single piece comprising a continuous binding body extended by a base plate. The binding body is maintained on the ski by torsional retaining means 50. These torsional retaining means 50 comprise, at the front of the boot, a locking finger 48 with an adjustable spring 49 and a rotatable pivot located on the longitudinal axis of the ski at a distance "a" from the attaching means. The pivot is positioned between the limits of the metatarsal region of feet corresponding to sizes between sizes 35 to 45.

These limits are designated by the letter "b" in FIG. 9. This structural arrangement has the advantage of taking account of the plantar support region at one of the most acted upon locations of the boot, since it participates actively in all phases of propulsion, support, and lateral retention during the striding phase of skiing. It is consequently this location that is most often subjected to torsional forces occurring at the level of the skier's foot, thus requiring a release capability when the forces exceed certain allowed limits sufficient to cause injuries to the skier.

In FIG. 9, the forward end of boot 40 is connected to a ski 41 by attaching means 42. Attaching means 42 comprises a base plate 43 extending rearwardly at least to the metatarsal region. Plate 43 comprises lateral retaining means 44 which cooperate with corresponding means arranged in sole 45 of the boot. Attaching means 42 comprises a binding body 46 at the forward end of which is provided a release ramp 47 with which a locking finger 48 cooperates. Finger 48 is acted on by an adjustable force spring 49. Moreover, base plate 43 comprises, approximately at the mid-length of the region of placement of the rotatable pivot 51 described above, a corresponding slot 52 adapted to receive pivot 51. This slot 52 is defined by an oblong hole so that when the forces to which the foot of the skier is subjected exceed the level of the selected adjustment, plate 43 can escape laterally after having pushed back locking finger 48 to a small extent in the longitudinal direction. In order that the boot-ski connection is always assured, despite the release position (illustrated in FIG. 10) of base plate 43, rotatable pivot 51 is provided with a shoulder 53 extending above the edges of oblong hole 52.

In addition, it is within the scope of the invention to provide a base plate which can free itself entirely from the ski during release. In this case, shoulder 54 will not be provided on the rotatable pivot. This embodiment is shown in FIGS. 11 and 12 with another type of attaching means 56, the construction of which will be understood by one skilled in the art without further illustration, it being understood that the same reference numerals are used to illustrate the same elements in FIGS. 9–12.

In these two embodiments it should also be understood that the rear portion of base plate 54 is restrained by an abutment 55 preventing all vertical displacement.

The binding shown in FIGS. 6 and 7 also discloses a holding mechanism 10 for holding the front of the boot so as to permit the heel of boot 2 to be lifted upward. In addition, in this embodiment, the binding is also adapted to permit boot 2 to pivot laterally around a vertical pivot axis pin 5. All the comments made with respect to the embodiment shown in FIGS. 4 and 5 apply to the embodiment shown in FIGS. 6 and 7, including the various locations that pivot pin 5 and the vertical pivot axis may assume beneath boot 2.

In addition, the binding seen in FIGS. 6 and 7 also comprises a locking mechanism for releasably holding the boot in a centered position. This centered position, as seen in FIGS. 5 and 6 is a position in which the longitudinal axis of the boot is substantially parallel to the longitudinal axis of the ski. The locking mechanism is adapted to release the boot from its central position so as to permit the boot to laterally pivot around axis pin 5 and the vertical pivot axis when a predetermined torsion moment is experienced by the locking mechanism. In addition, the locking mechanism is adapted to vary the force with which it biases boot 2 against lateral pivoting, so that the torsion moment necessary to release the boot and allow lateral pivoting may also be varied. In other words, the locking mechanism has a predetermined threshold, such that when a torsion moment applied to the boot is above that threshold, the boot is free to pivot laterally. Pivot axis pin 5 and the vertical pivot axis of the binding are located sufficiently close to the point at which the lateral force acts on boot 2 in support zone 4, that the torsion moment created by this force is less than the threshold above which injury to the skier would occur in a fall.

FIG. 13 illustrates in more detail the embodiment illustrated in FIGS. 5 and 6.

The binding comprises a base plate 62, jaws 63, and an elastic means mounted in the front part of base plate 62. The elastic means comprises a ball 65, spring 66 and setscrew 67. Base plate 62 is mounted to rotate around a pin 61, which is connected to a base plate 69. A clamp 64 is arranged to pivot in jaws 63. Jaws 63 hold the front of boot 78. Elements 63, 64, 65, 66, and 67 are arranged in one integral unit with base plate 62 on ski 70.

When the release threshold of the binding is reached ball 65 slides out of recess 68 in base plate 69. In addition, the release threshold of the binding can be changed by rotating setscrew 67. Also, binding element 72 for clamp 64 is arranged to pivot between two flanges 71 in the front of base plate 69.

When stress is experienced by the binding of the present invention, clamp 64 also slides to the side out of recess 77 because clamp 64 is connected through jaws 3 with the rotatable binding.

When a foot is inserted into the binding, clamp 64 is pivoted upwardly and is then pivoted downwardly until it engages the oblique surface 73 of binding element 72.

Binding element 72 is adapted to be tipped forward toward the ski by pressure, e.g. applied with a ski pole, in the direction of the arrow in FIG. 13, over a pin 76 and against the bias of a spring 75. Clamp 64 then slides downwardly on oblique surface 73 and engages a recess 77 of binding element 72. Boot 78 is thus held tightly by the binding.

The bottom part of binding element 72 is provided with a stop configured as a cam surface 79, which is an end portion of binding element 72, so that binding element 72 cannot tip in the direction of boot 78. Spring 75 and pin 76 are thus also prevented from sliding out of bore 80. The pressure of spring 75 can be varied by the rotation of a screw 81.

To release the bottom from the ski binding, a ski pole point is inserted into bore 82 of binding element 72. With a brief thrust in the direction of the ski, clamp 64 springs out of recess 77 and moves rapidly upwardly.

Clamp 64 is curved so that as great as possible a space A exists between the pressure point of clamp 64 and the jaws 63, to allow safe removal of boot 78.

The present invention is not limited to its use in the two types of bindings described above. The invention may be used with all other types of known bindings.

Because the position of journal axis 9 varies as a function of the shoe size of the skier, a unique apparatus was developed which retains the advantages of the invention described above, while at the same time being adaptable to all shoe sizes. In this embodiment of the invention, the vertical pivot axis is shifted slightly with respect to journal axis 9 so as to accommodate different shoe sizes, yet remains in the immediately vicinity of journal axis 9 so that lever arm l (as seen in FIGS. 1 and 2) is substantially zero or small, and the torsion moment F1 remains insufficient to cause an untimely release of the binding under normal skiing conditions.

Figure 8:
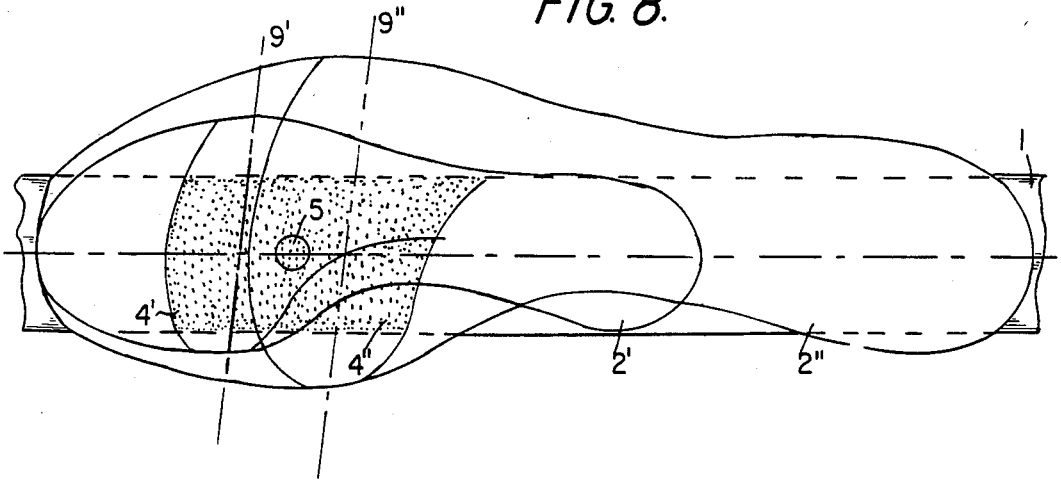
FIG. 8 illustrates the localization zone around the pivoting axis according to the present invention which is useful for adapting the present invention for use with different boot sizes.

This binding, which is schematically shown in FIG. 8, is adapted to attach a small-sized boot 2′ or, a large-sized boot 2″ to ski 1. Small-sized boot 2′ is adapted to receive a small-sized foot having a small support zone 4′ associated therewith. Large-sized boot 2″ is adapted to receive a large-sized foot having a large support zone 4″ associated therewith. In this embodiment, the pivot pin 5 and/or the vertical pivot axis may be positioned beneath the area in common with both the large and small support zones 4′ and 4″, respectively. In addition, within this area in common with both the large and small support zones, pivot axis pin 5 and/or the vertical pivot axis are preferably located halfway between a first journal axis 9′ associated with the small foot and comprising the axis around which the metatarsals in the small foot are journalled on the phalanges in the small foot, and a second journal axis associated with the large foot. The large journal axis comprises the axis around which the metatarsals in the large foot are journalled on the phalanges of the large foot. Thus, satisfactory results can be obtained by the skier, regardless of his shoe size when using this type of binding, and the skier will not have to "strengthen" the locking mechanism of his safety binding to prevent untimely release of boot 2.

In an alternative embodiment, the position of pivot pin 5 and/or the vertical pivot axis can be adjusted to a certain extent along the longitudinal axis of the ski, for example, by using a screw apparatus.

Although the invention has been described with respect to particular means and embodiments, it is to be understood that the invention is not limited to the particulars disclosed and extends to all equivalents falling within the scope of the claims.

What is claimed is:

1. An apparatus for connecting a ski boot having a heel to a ski, wherein said boot is adapted to receive a foot having a plurality of metatarsals, a plurality of phalanges adjacent said plurality of metatarsals and a support zone associated therewith, wherein said apparatus comprises a binding adapted to permit the heel of said boot to be lifted from said ski in normal use, and adapted to permit said boot to pivot around a vertical pivot axis, and wherein said vertical pivot axis passes through said support zone of said foot, when said foot is received in said boot held by said apparatus, wherein said support zone is the area of said foot bounded by the front edge of said phalanges of said foot adjacent said metatarsals and the rear edge of said metatarsals of said foot.

2. The apparatus of claim 1 wherein said binding is a cross-country ski binding.

3. The apparatus of claim 1 wherein said binding is adapted to permit said boot to pivot in a plane parallel to the top surface of said ski.

4. The apparatus of claim 1 wherein said binding further includes a locking means for releasably holding said boot in a centered position on said ski.

5. The apparatus of claim 5 wherein said centered position of said boot is a position in which said longitudinal axis of said boot is substantially parallel to the longitudinal axis of said ski.

6. The apparatus of claim 6 wherein said locking means releases said boot from its centered position so as to permit said boot to pivot around said vertical pivot axis when a predetermined torsion moment is experienced by said locking means.

7. The apparatus of claim 7 wherein said locking means is adapted to vary said predetermined torsion moment which releases said boot.

8. The apparatus of claim 1 further including an axis pin, pivotally attaching at least a portion of said binding to said ski and through which said vertical pivot axis passes, wherein said axis pin is located under said boot.

9. The apparatus of claim 1 wherein said vertical pivot axis passes approximately through the intersection of the longitudinal axis of said ski and a journal axis around which a metatarsal of said foot is adapted to rotate with respect to a phalange of said foot, when said foot is received in said boot held by said apparatus.

10. The apparatus of claim 1 wherein said binding further includes a holding means for holding the front of said boot, a plate, and a pivot pin pivotally attaching said plate to said ski, so that said plate is adapted to rotate around said vertical pivot axis which passes through said pivot pin.

11. The apparatus of claim 10 wherein said foot comprises a third metatarsal and a third phalange wherein said pivot pin is positioned approximately under the area between said third metatarsal and third phalange of said foot, when said foot is received in said boot held by said binding.

12. The apparatus of claim 11 wherein said binding is adapted to attach a small or a large- sized boot to said ski, wherein said small-sized boot is adapted to receive a small-sized foot having a small support zone associated therewith, and said large-sized boot is adapted to receive a large-sized foot having a large support zone associated therewith, wherein said pivot pin is positioned beneath the area in common with both said large and small support zones.

13. The apparatus of claim 12 wherein said pivot pin is positioned between a first and second journal axis, said first journal axis being associated with said small foot and comprising the axis around which a metatarsal of said small foot is journalled around a phalange of said small foot when said small foot is received in said small-sized boot held by said binding, and said second journal axis being associated with said large foot and comprising the axis around which a metatarsal of said large foot is journalled on a phalange of said large foot, when said large foot is received in said large-sized boot held by said binding.

14. The apparatus of claim 13, wherein said pivot pin is positioned halfway between said first and second journal axes.

15. The apparatus of claim 1 wherein said binding is adapted to attach a small or a large-sized boot to said ski, wherein said small-sized boot is adapted to receive a small-sized foot having a small support zone associated therewith, and said large-sized boot is adapted to receive a large-sized foot having a large support zone associated therewith, wherein said vertical pivot axis passes through the area in common with both said large and small support zones.

16. The apparatus of claim 16 wherein said vertical pivot axis is positioned between a first and a second journal axis, wherein said first journal axis is associated with said small-sized foot and comprises the axis around which the metatarsal of said small foot is journalled on said phalange of said small foot, when said small foot is received in said small-sized boot held by said binding, and wherein said second journal axis is associated with said large foot and comprises the axis around which the metatarsal of said large foot is journalled on the phalange of the large foot, when said large foot is received in said large-sized boot held by said binding.

17. The apparatus of claim 1 wherein said binding further comprises a plate for supporting said foot and through which said pivot axis extends wherein said binding is adapted to adjust the position of said plate along the longitudinal axis of said ski.

18. The apparatus of claim 1 wherein said binding further comprises:

means for holding the front of said boot; and means for pivoting said boot around said vertical pivot axis, wherein said pivoting means is spaced a distance from said holding means in the longituidnal direction of said ski.

19. An apparatus for connecting a ski boot to a ski, wherein said boot is adapted to receive a foot having a support zone associated therewith, wherein said foot comprises a plurality of metatarsals and phalanges adjacent said metatarsals, wherein in normal use by a skier, a lateral force may be generated by the skier's foot against said boot in said support zone, wherein said support zone is positioned between the front edge of said phalanges adjacent said metatarsals and the rear edge of the metatarsals of said foot wherein the said apparatus comprises:

(a) holding mens for holding the front of said boot and permitting the heel of said boot to be raised from said ski; and (b) a pivoting means for permitting said to pivot laterally, around a pivot axis, wherein said pivot axis is sufficiently close to a line passing through the point at which said force is applied to said boot in the direction of said force, that the torsional moment created by said force is less than the threshold above which injury to the skier would occur in a fall.

20. The apparatus of claim 19 wherein said force is applied to said boot at a point along a journel axis on which a metatarsal pivots on a phalange of said foot.

21. The apparatus of claim 19 wherein said pivot axis is located closer to said line than the front edge of the longest toe of said foot when said foot is received in said boot held by said apparatus.

22. The apparatus of claim 20 wherein the position of said pivot axis is such that the torsional moment created by said force is substantially zero.

23. The apparatus of claim 20 further including a locking means for releasably holding said boot against lateral pivoting.

24. The apparatus of claim 22 wherein said locking means has a predetermined threshold such that when the torsional moment applied to said boot is above said threshold, said boot is free to pivot laterally, wherein said pivot axis is positioned with respect to a line passing through the point at which said force is applied to said boot in the direction of said force that said torsional moment created by said force is less than a threshold above which injury to said skier would occur in a fall.

25. The apparatus of claim 20 wherein said pivot axis passes through said support zone, when said foot is received in said boot held by said apparatus.

26. The apparatus of claim 20, wherein said pivot axis passes approximately through a journal axis comprising the axis around which a metatarsal of said foot is journalled on a phalange of said foot, when said foot is received in said boot held by said apparatus.

27. The apparatus of claim 20 wherein said pivoting means comprises a plate and an axis pin pivotally attaching said plate to said ski, wherein said axis pin defines said pivot axis which passes therethrough.

28. The apparatus of claim 27 wherein said pivot pin is located approximately under the area between said third metatarsal and said third phalange of said foot when said foot is received in said boot.

29. The apparatus of claim 20 wherein said apparatus is adapted to attach a small or a large-sized boot to said ski, wherein said small-sized boot is adapted to receive a small-sized foot having a small support zone associated therewith, and said large-sized boot is adapted to receive a large-sized foot having a large support zone associated therewith, wherein said pivot axis passes through the area in common with both said large and small support zones, when said foot is received in said boot held by said apparatus.

30. The apparatus of claim 29 wherein said pivot axis is positioned between a first journal axis and a second journal axis, said first journal axis being associated with said small foot and comprising the axis around which a metatarsal of said small foot is journalled on a phalange of said small foot, when said foot is received in a boot held by said apparatus, said second journal axis being associated with said large foot and comprising the axis around which a metatarsal of said large foot is journalled on a phalange of said large foot when said large foot is received in a said boot held by said apparatus.

31. An apparatus for attaching a boot to a ski and wherein said boot is adapted to receive a foot therein, comprising a binding adapted to hold the front of said boot and allow the heel of said boot to be raised, and adapted to permit said boot to pivot around a vertical pivot axis, wherein said pivot axis is located closer to a journal axis on which a metatarsal of said foot is journalled on a phalange of said foot adjacent said metatarsal than the front edge of the longest toe of said foot when said foot is received in said boot held by said binding.

32. An apparatus for connecting a ski boot having a heel to a ski in combination with said ski boot, wherein said boot is adapted to receive a foot having a plurality of metatarsals, a plurality of phalanges adjacent said metatarsals, and a support zone associated therewith, wherein said apparatus comprises a binding adapted to permit the heel of said boot to be lifted from said ski in normal use, and adapted to permit said boot to pivot around a vertical pivot axis, and wherein said vertical pivot axis passes through said support zone of said foot when said foot is received in said boot held by said apparatus, wherein said support zone is the area of said foot bounded by the front edge of said phalanges of said foot adjacent said metatarsals and the rear edge of said metatarsals of said foot.

* * * * *